United States Patent [19]

Maeda

[11] Patent Number: 4,471,946

[45] Date of Patent: Sep. 18, 1984

[54] IDLING DEVICE FOR LEVER HOIST

[75] Inventor: Kazuo Maeda, Yokohama, Japan

[73] Assignee: Kabushiki Kaisha Kito, Kawasaki, Japan

[21] Appl. No.: 473,407

[22] Filed: Mar. 9, 1983

[30] Foreign Application Priority Data

May 28, 1982 [JP] Japan ..... 57-89768

[51] Int. Cl.[3] ..... B66D 1/14; B66D 5/32

[52] U.S. Cl. ..... 254/350; 254/353; 254/376

[58] Field of Search ..... 254/369, 350, 351, 352, 254/353, 357, 365, 366, 372, 376, 380; 192/94, 95, 16

[56] References Cited

U.S. PATENT DOCUMENTS

| | | | |
|---|---|---|---|
| 812,817 | 2/1906 | Bryan | 192/94 X |
| 2,165,984 | 7/1939 | Schroeder | 254/350 X |
| 3,047,114 | 7/1962 | Stevens, Jr. | 254/350 X |

*Primary Examiner*—Stuart S. Levy
*Assistant Examincr*—Katherine Jaekel
*Attorney, Agent, or Firm*—Sughrue, Mion, Zinn, Macpeak, and Seas

[57] ABSTRACT

An idling device is able to bring into an idling condition a lever hoist including a change gear provided on driving member threadedly engaged on a driving shaft for driving a sheave for winding-up a chain or rope for a load, an operating lever rockably driven by a hand, winding-up and winding-off driving pawls engageable with teeth of the change gear and changeable in response to the purpose of hoisting or lowering the load, and a braking assembly for preventing the change gear from being driven by a gravity of the load and adapted to be clamped and released by rotative movement of the driving member relative to said driving shaft. According to the invention the idling device comprises a stopper fixed to the driving shaft and a manually operatable knob fitted on and rotatably and axially slidably relative to the driving shaft between the stopper and the driving member and provided with engagement protrusions adapted to be engaged in recesses formed in the driving member. The knob is formed with stopper protrusions integrally on a bottom of its cavity for receiving the stopper. The stopper is formed with recesses for receiving the stopper protrusions in the idling condition and is further formed with engagement surfaces in opposition to the stopper protrusions of the knob for preventing excess release of the braking assembly.

6 Claims, 6 Drawing Figures

IDLING DEVICE FOR LEVER HOIST

BACKGROUND OF THE INVENTION

1. Field of the Invention

The present invention relates to an idling device for a lever hoist capable of maintaining its braking assembly in a released condition during idling operation of the hoist but making the assembly clamped or operative in lifting and lowering a load.

2. Description of the Prior Art

Idling devices for lever-operated small type hoisting and dragging devices are known. One of these devices includes an elastic resistance member interposed between a driving member repeatedly driven by a lever and a driven member of a braking assembly for releasing a braking assembly.

With the known device, since a spring force always acts in a direction releasing the braking assembly, a clamping force for the braking assembly is insufficient when a light load is being hoisted. In hoisting such a light load, therefore, when the lever is repeatedly rocked, the driving member is returned by a return movement of the lever for a next driving movement. Accordingly, such a device cannot hoist a light load. In lowering a light load, on the other hand, a torque resulting from the light load turns a load sheave to cause the load to drop, with the result that such a light load cannot be lowered by the rocking movement of the lever.

SUMMARY OF THE INVENTION

It is an object of the invention to provide an improved idling device for a lever hoist which eliminates the above disadvantages of the prior art and is capable of lifting and lowering even a light load by repeatedly rocking a lever by providing a particular stopper and a knob.

An idling device for a lever hoist including a change gear a provided on a driving member threadedly engaged on a driving shaft for driving a sheave winding up a chain, rope or the like thereabout for a load. An operating lever is rockable about said driving member by hand and a winding-up driving pawl is engageable with teeth of the change gear and driven by the operating lever in a winding-up direction for the load. A winding-off driving pawl engages with the teeth of said change gear and is driven by the operating lever in a winding-off direction for the load. A braking assembly prevents the change gear from being driven from a side of the sheave and being clamped and released by rotative movement of the driving member relative to said driving shaft. A stopper is fixed to the driving shaft at its one end on an opposite side of the braking assembly with respect to said change gear. A manually operatable knob is fitted on and is rotatably and axially slidably relative to the driving shaft between the stopper and the driving member and is provided with rotative movement transmitting means for transmitting rotative movement between the knob and said driving member. The stopper includes holding means for preventing the knob from rotating relative to the driving shaft and hence prevents the driving member from clamping the braking assembly.

The invention will be more fully understood by referring to the following detailed specification and claims taken in connection with the appended drawings.

DETAILED DESCRIPTION OF THE PREFERRED EMBODIMENT

Figure 1:
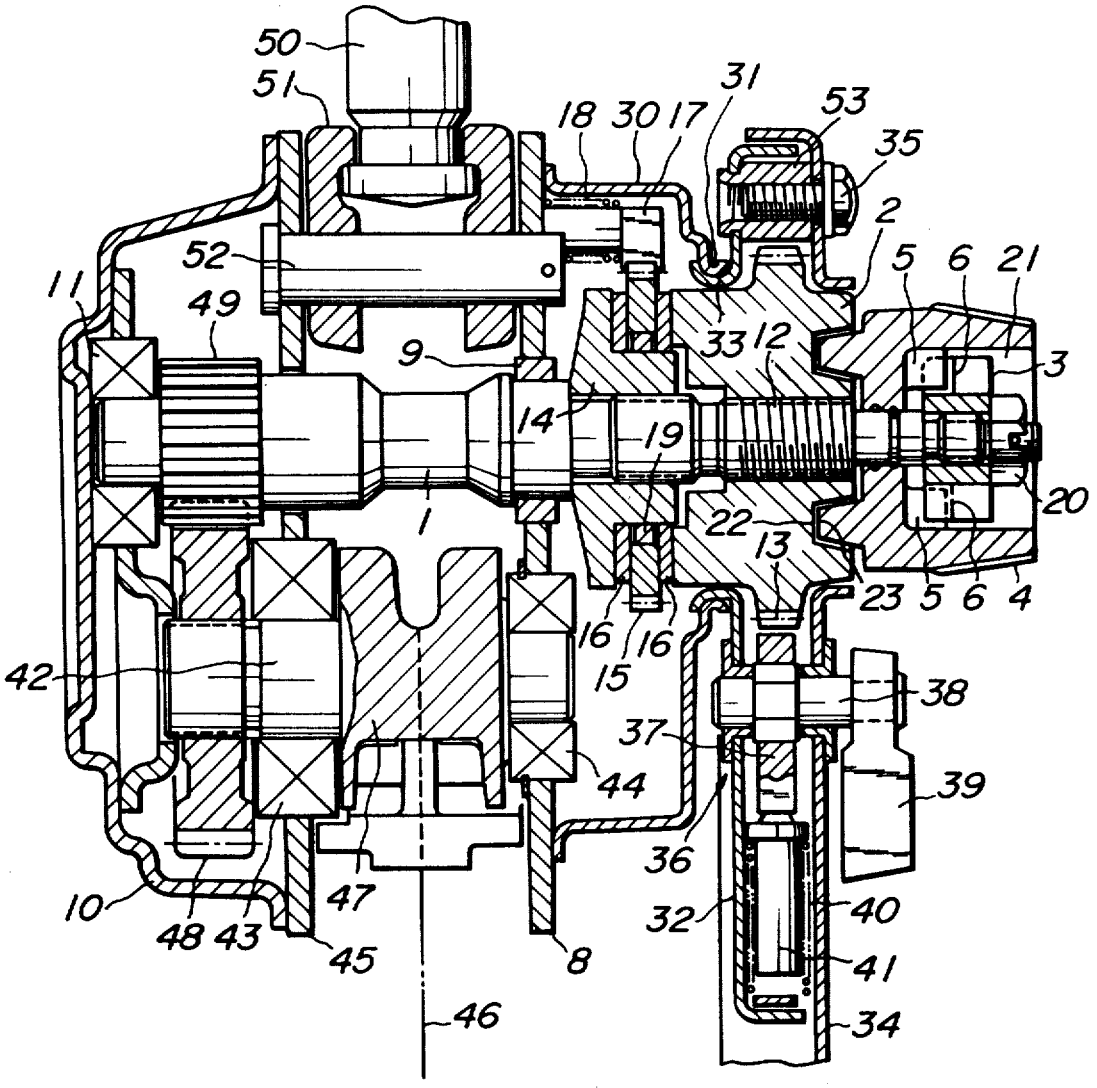
FIG. 1 is a sectional view of a part of a lever hoist under an operated condition provided with an idling device according to the invention.
Figure 2:
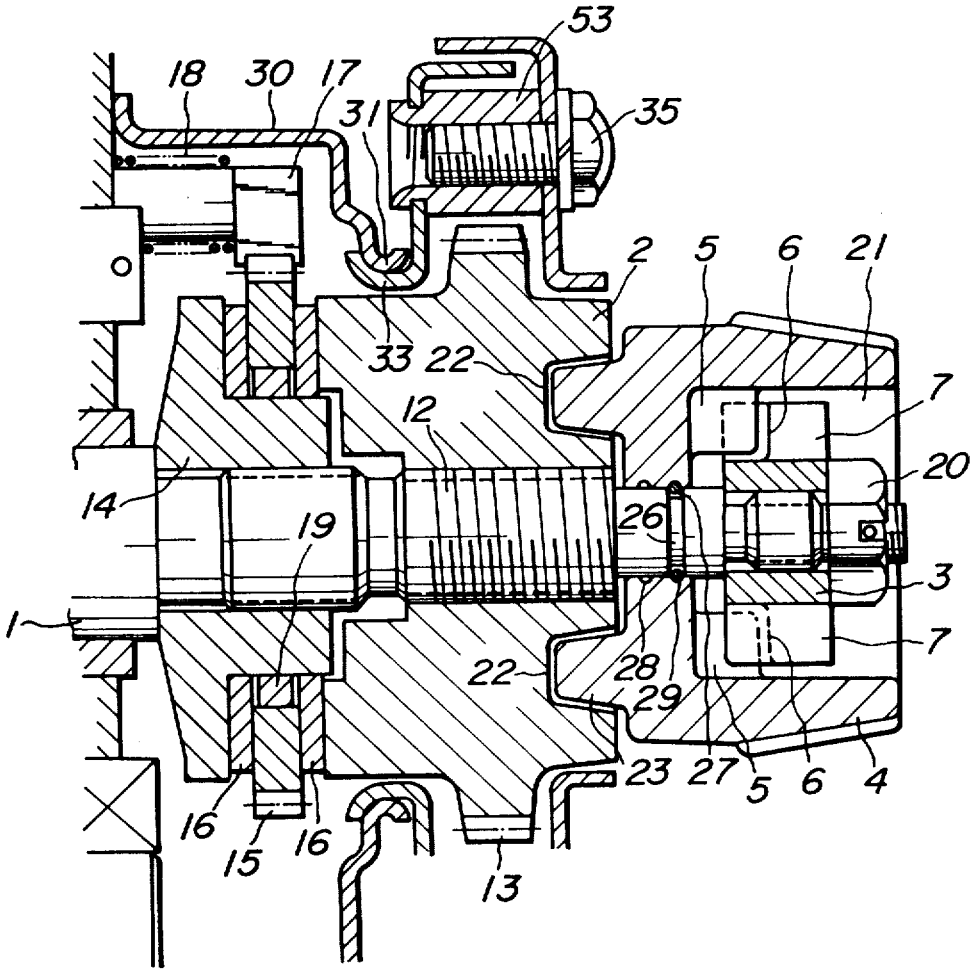
FIG. 2 is an enlarged sectional view of a part of the lever hoist shown in FIG. 1.

Referring to FIGS. 1–6 illustrating one embodiment of the invention, a driving shaft 1 is journaled at its mid portion by a bearing 9 in a frame 8 and has a front end (left end as viewed in FIG. 1) journaled by a bearing 11 in a gear box 10 and a rear portion formed with external screw threads 12 for a braking assembly adapted to be threadedly engaged with internal screw threads of a driving member 2 having change gear teeth 13. A driven member 14 is also fitted on the driving shaft 1 against rotation relative thereto between the frame 8 and driving member 2 and abuts against an enlarged diameter portion of the driving shaft 1 journaled by the bearing 9.

In the specification, the words "front" or "forward" mean the side of a sheave of the lever hoist or the left side as viewed in FIG. 1, while the word "rear" means the side of an operating lever or the right side as viewed in FIG. 1.

Between the driving member 2 and the driven member 14 are interposed a brake ratchet wheel 15 and friction plates 16 abutting against opposite sides thereof. A brake pawl 17 pivotally secured to the frame 8 is brought into engagement with the brake ratchet wheel 15 by an engagement spring 18. The brake ratchet wheel 15 has a center hole within which is fitted an oilless bearing 19 of a sintered alloy. The ratchet wheel 15, friction plates 16 and bearing 19 are fitted on a reduced diameter portion of the driven member 14 to form a braking assembly. In hoisting and lowering a heavy load, the driving shaft 1 tends to be rotated by the force of gravity exerted on the load, so that when the driving shaft 1 is rotated, the driving member 2 is moved toward the braking assembly or to the left as viewed in FIG. 1 because of the threaded engagement of the driving shaft 1 and driving member 2. Accordingly, the driving member 2 urges the ratchet wheel 15 and friction plates 16 against the driven member 14 so that the driving shaft 1 is prevented from rotating with the aid of the brake pawl 17 connected to the frame 8.

A stopper 3 is fitted on a reduced diameter portion of the driving shaft 1 at a rear end against rotation relative thereto and fixed thereat by means of a nut 20 locked to the driving shaft by a split pin. A knob 4 for manually quickly rotating the driving shaft 1 is formed with a cavity 21 for receiving the stopper 3 and is fitted on the driving shaft rotatably and axially slidably thereon between the stopper 3 and a shoulder of the screw threaded portion 12 of the driving shaft 1. The driving member 2 is formed with engagement holes 22 on its rear end surface on a side of the knob 4 for receiving engagement protrusions 23 integrally formed on a front end surface of the knob 4 to form an engagement portion for transmitting the rotative movement between the driving member 2 and the knob 4.

Figure 3:
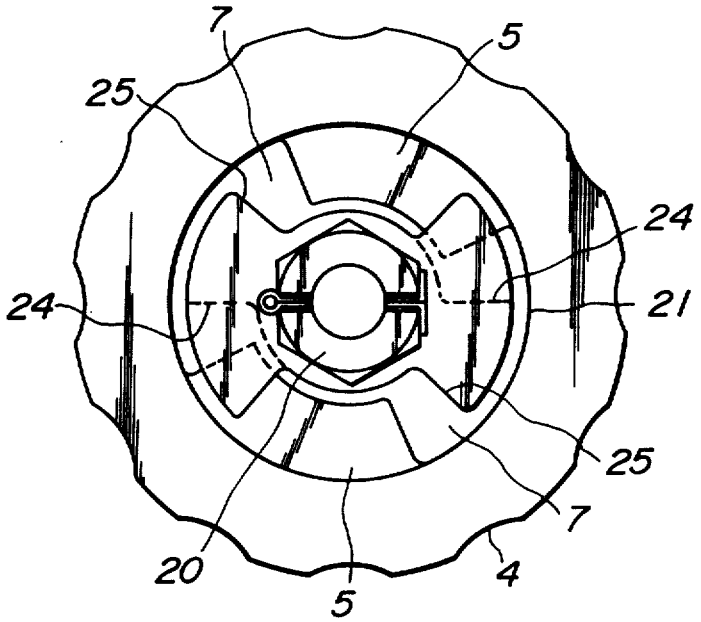
FIG. 3 is a side view of a part of the idling device shown in FIG. 1.
Figure 4:
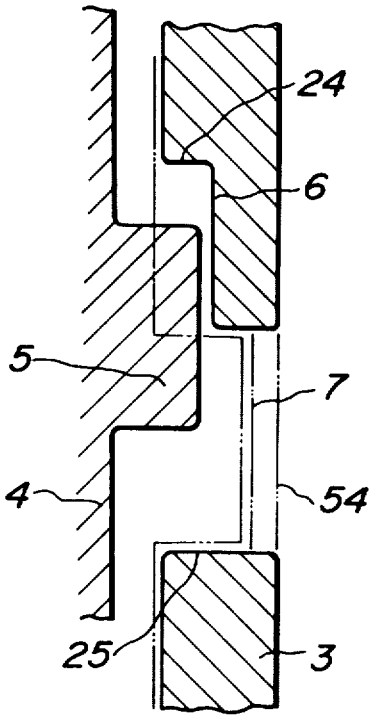
FIG. 4 is a development sectional view illustrating a relation between a manually operatable knob and stopper constituting the idling device according to the invention.
Figure 5:
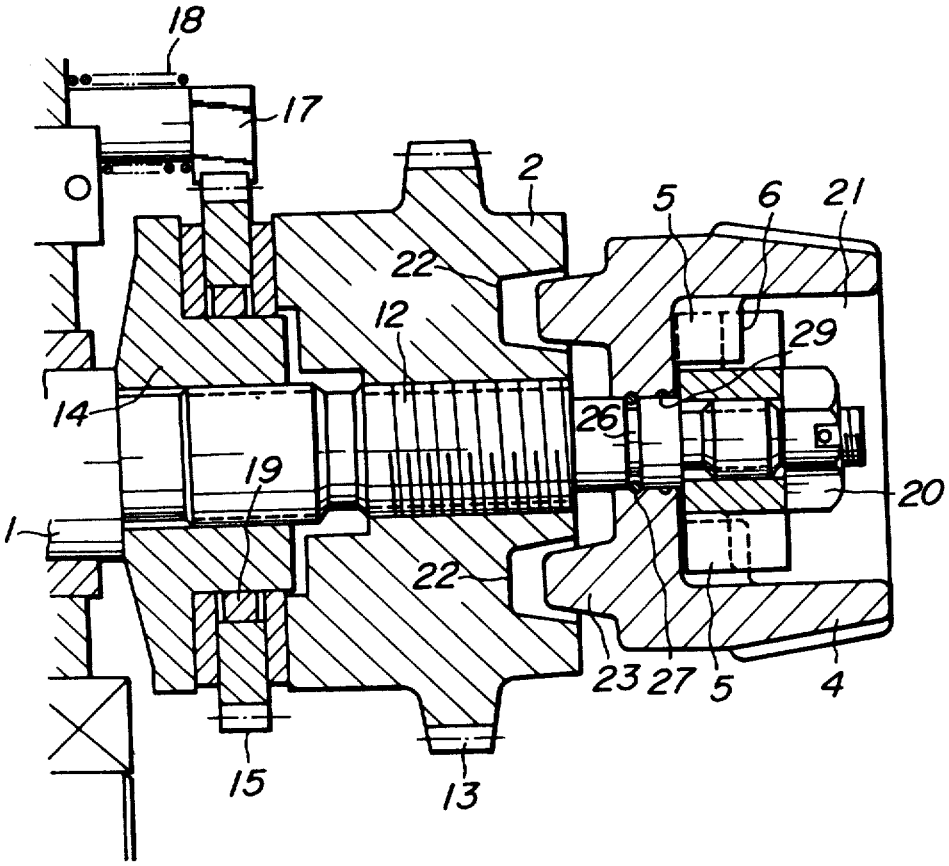
FIG. 5 is a sectional view of the idling device under an idling condition according to the invention.
Figure 6:
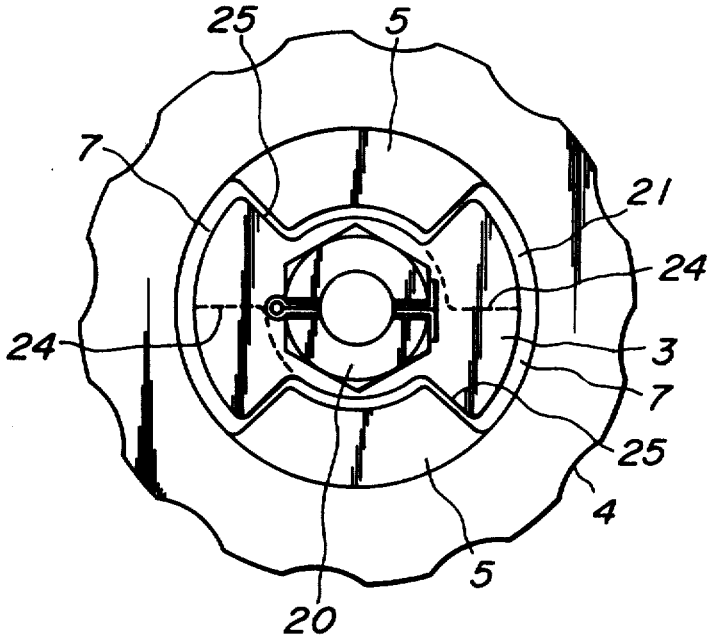
FIG. 6 is a side view of a part of the idling device shown in FIG. 5.

The knob 4 is formed integrally on a bottom of the cavity 21 for receiving the stopper 3 with a plurality of stopper protrusions 5 equally spaced in a circumferential direction of the knob 4. The stopper 3 is provided with engagement surfaces 6 which prevent the knob 4 from retracting or moving away from the driving member 2 and are adapted to be arranged in contact with or closely adjacent to rear surfaces of the stopper protrusions 5 in the clamped or operating condition of the braking assembly (FIG. 3) and is further provided with recesses 7 for receiving the stopper protrusions 5 to permit the knob to retract from the driving member 2 in the released or inoperative condition of the braking assembly (FIG. 6). The stopper 3 is further provided on its front side with engagement surfaces 25 in opposition to side surfaces of the stopper protrusions 5 for preventing excess release of the braking assembly and includes spaces between the other side surfaces of the stopper protrusions 5 and front side surfaces 24 of the stopper 3 for permitting the brake clamping rotation of the knob 4 (FIG. 3).

The driving shaft 1 is formed, in the reduced diameter portion onto which the knob 4 is fitted, with an annular groove 26 in which an annular spring 27 is fitted for anchoring the knob on the driving shaft. On the other hand, the knob is formed, in its inner surface fitted on the driving shaft 1, with an annular engagement groove 28 adapted to detachably receive the annular spring 27, for determining the idling position of the knob 4 and an annular engagement groove 29 adapted to detachably receive the annular spring 27 for determining the non-idling position of the knob 4.

The driven member 14, brake ratchet wheel 15, friction plates 16, brake pawl 17 and front part of the driving member 2 are covered by a metal brake cover 30 formed on its rear side by pressing with a fixed support ring 31 having a U-shaped cross-section in opposition to an intermediate outer circumferential surface of the driving member 2. An inner lever component member 32 made of metal plates is formed by pressforming with a rotatable support ring 33 on its intermediate portion adjacent to the brake cover 30. The rotatable support ring 33 is adapted to be fitted in the fixed support ring 31 rotatably but against axial movement relative thereto in a manner enclosing the support ring 31. Cylindrical spacers 53 having internal screw threads are fitted and fixed by calking in apertures of the bottom portion of inner and outer lever component members 32 and 34 which are joined by connecting bolts 35 threadedly engaged within the spacer 53 to form an operating lever 36 rockable about a center line of the change gear 13.

The brake cover 30 is fixed on its side opposite to the fixed support ring 31 to the frame 8 by means of bolts (not shown). A handle or knob 39 is fixed to a pivot shaft 38 rotatably supported in the operating lever 36. To the pivot shaft 38 rotatably supported in the operating lever 36 is fixed a change-over pawl member 37 including a winding-up direction driving pawl and a winding-off direction driving pawl which are detachably engageable with the change gear 13 and a winding-up direction holding engagement portion, a winding-off direction holding engagement portion and a neutral position holding engagement portion. The change-over pawl member 37 is engaged with a holding member 41 adapted to be urged thereto by means of an engagement or urging spring 40.

A driven shaft 42 is arranged in parallel with and under the driving shaft 1. A mid portion of the driven shaft 42 is journaled in a bearing 43 in a frame 45 closing an opening of a gear box 10 and a rear end of the shaft 42 is journaled in a bearing 44 in the frame 8. The driven shaft 42 is formed integrally with a load sheave 47 between the frames 8 and 45 for winding a chain 46 (symbolically shown in a chain line in FIG. 1) thereabout. In the gear box 10, the driven shaft 42 is provided with a large gear 48 fixed thereto adapted to engage a pinion 49 formed in the front end of the driving shaft 1.

In FIG. 1, an upper hook 50 is anchored to a hook support metal 51 mounted on a support rod 52 extending between the frames 8 and 45.

In the above embodiment, the engagement protrusions 23 are formed on the knob 4, while the engagement holes 22 are formed in the driving member 2. As an alternative, the engagement holes 22 may be formed in the knob 4, while the engagement protrusions 23 may be formed on the driving member. Another means for determining the idling and non-idling positions of the knob 4 may be used. For example, the knob 4 may be provided with an engagement spring and the driving shaft may be correspondingly provided with a plurality of spring receiving portions in its longitudinal direction with an interval. The annular spring 27 for determining the idling position of the knob 4 may be an annular metal spring which is partially cut-off or may be a rubber ring. The protrusion 5 and recess 7 may be only one set of them. If two or more sets of them are provided, they need not be arranged with equal intervals. In order to close the rear end of the recesses 7 a cover 54 (FIG. 4) may be provided which is formed integrally with the stopper 3 or secured thereto by welding or the like.

According to the invention, starting from a condition wherein the driving shaft 1 is held not to rotate by gripping the load chain 46 or other means, the knob 4 together with the driving member 2 is rotated in a brake releasing direction to bring the stopper protrusions 5 of the knob 4 from positions engaging the engagement surfaces 6 to positions in opposition to the recesses 7 of the stopper 3 and then the knob 4 is retracted or moved to the right as viewed in FIG. 1. In this manner, the braking assembly can be simply kept in the released condition, so that the idling operation of the hoist can be effected by rotating the knob 4 or pulling the load chain 46. Moreover, after the knob 4 is moved forward or toward the left as viewed in FIG. 1 to remove the protrusions 5 from the recesses 7, the knob 4 is rotated in a brake clamping direction, so that the braking assembly is changed from the idling or released condition into the clamped or operating condition, thereby lifting and lowering a light load without any trouble. In this case, the above operation for rotating the knob 4 in the brake clamping direction is not necessarily needed, because the subsequent operation of the lever 36 causes the knob 4 to move into the brake clamping direction. Furthermore, when the braking assembly is changed from the idling or released condition to the clamped or operating condition, the engagement surfaces 6 of the stopper 3 fixed to the rear end of the driving shaft 1 are arranged immediately behind the protrusions 5 of the knob 4, thereby preventing the changing over of the braking assembly into the idling or released condition due to an error or unintentional operation in lifting or lowering a load.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An idling device for a lever hoist including a change gear provided on a driving member threadedly engaged on a driving shaft for driving a sheave winding up a chain, rope or the like thereabout for a load, an operating lever rockable about said driving member by hand, a winding-up driving pawl engageable with teeth of said change gear and driven by said operating lever in a winding-up direction for the load, a winding-off driving pawl engageable with the teeth of said change gear and driven by said operating lever in a winding-off direction for the load, and braking means for preventing said change gear from being driven from said sheave, said braking means being clamped and released by rotative movement of said driving member relative to said driving shaft, said device comprising a stopper fixed to said driving shaft at its one end on an opposite side of said braking assembly with respect to said change gear, and a manually operatable knob fitted on and rotatably and axially slidable relative to said driving shaft between said stopper and said driving member and provided with rotative movement transmitting means for transmitting rotative movement between said knob and said driving member and said stopper including holding means for preventing said knob from rotating relative to said driving shaft and hence preventing said driving member from clamping said braking assembly.

2. An idling device as set forth in claim 1, wherein said rotative movement transmitting means comprises engagement protrusions and recesses for receiving said protrusions formed in the opposite surfaces of said driving member and said knob, respectively.

3. An idling device as set forth in claim 1, wherein said holding means comprises protrusions formed on said knob and recesses formed in said stopper.

4. An idling device as set forth in claim 1, wherein said stopper comprises means for preventing said knob from moving away from said driving member, thereby preventing said braking assembly from releasing in lifting and lowering a load.

5. An idling device as set forth in claim 1, wherein said knob is formed integrally, on a bottom of a cavity receiving therein said stopper, with a plurality of stopper protrusions in the form of arches equally spaced in a circumferential direction of said knob and said stopper is formed with recesses for receiving said stopper protrusions of said knob to form said holding means with said stopper protrusions.

6. An idling device as set forth in claim 5, wherein said stopper is further formed with engagement surfaces in opposition to said stopper protrusions of said knob for preventing excess release of said braking assembly.

* * * * *